US007939485B2

(12) United States Patent
Price et al.

(10) Patent No.: US 7,939,485 B2
(45) Date of Patent: May 10, 2011

(54) BENEFIT AGENT DELIVERY SYSTEM COMPRISING IONIC LIQUID

(75) Inventors: Kenneth Nathan Price, Wyoming, OH (US); Stacie Ellen Hecht, West Chester, OH (US); Glenn Thomas Jordan, IV, Indian Springs, OH (US); Corey James Kenneally, Mason, OH (US); Yousef Georges Aouad, Cincinnati, OH (US); Michael Stanford Showell, Cincinnati, OH (US); Gregory Scot Miracle, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 451 days.

(21) Appl. No.: 11/263,389

(22) Filed: Oct. 31, 2005

(65) Prior Publication Data

US 2006/0094617 A1 May 4, 2006

Related U.S. Application Data

(60) Provisional application No. 60/624,051, filed on Nov. 1, 2004.

(51) Int. Cl.
*C11D 3/37* (2006.01)
*C11D 3/00* (2006.01)

(52) U.S. Cl. ..... 510/276; 8/137

(58) Field of Classification Search ..... 510/262; 8/137

See application file for complete search history.

(56) References Cited

U.S. PATENT DOCUMENTS

| | | | | |
|---|---|---|---|---|
| 3,075,921 | A | 1/1963 | Brocklchurst et al. | |
| 3,282,728 | A | 11/1966 | Lacroux et al. | |
| 3,896,033 | A | 7/1975 | Grimm, III | |
| 4,126,573 | A | 11/1978 | Johnston et al. | |
| 4,170,453 | A | 10/1979 | Kitko | |
| 4,189,311 | A | 2/1980 | Laqua et al. | |
| 4,348,292 | A | 9/1982 | Ginn | |
| 4,606,838 | A | 8/1986 | Burns | |
| 4,634,551 | A | 1/1987 | Burns et al. | |
| 4,681,592 | A | 7/1987 | Hardy et al. | |
| 4,689,168 | A | 8/1987 | RequeJo et al. | |
| 4,717,507 | A | 1/1988 | Schwadtke et al. | |
| 4,756,850 | A | 7/1988 | Nayar | |
| 4,783,278 | A | 11/1988 | Sanderson et al. | |
| 5,250,121 | A | 10/1993 | Yamamoto et al. | |
| 5,290,475 | A | 3/1994 | Wixon | |
| 5,476,660 | A * | 12/1995 | Somasundaran et al. | 424/401 |
| 5,545,350 | A | 8/1996 | Baker et al. | |
| 5,705,466 | A | 1/1998 | Baillely | |
| 5,731,101 | A | 3/1998 | Sherif et al. | |
| 5,798,329 | A | 8/1998 | Taylor et al. | |
| 5,827,602 | A | 10/1998 | Koch et al. | |
| 5,908,820 | A | 6/1999 | Oakes et al. | |
| 6,048,388 | A | 4/2000 | Schwarz et al. | |
| 6,086,785 | A | 7/2000 | Roesler et al. | |
| 6,165,448 | A | 12/2000 | Joiner et al. | |
| 6,180,587 | B1 | 1/2001 | Fuller et al. | |
| 6,274,539 | B1 | 8/2001 | Kacher et al. | |
| 6,277,808 | B1 | 8/2001 | Tcheou et al. | |
| 6,280,883 | B1 | 8/2001 | Lamanna et al. | |
| 6,288,281 | B1 | 9/2001 | Nemeth et al. | |
| 6,339,182 | B1 | 1/2002 | Munson et al. | |
| 6,372,829 | B1 | 4/2002 | Lamanna et al. | |
| 6,416,557 | B1 | 7/2002 | Ona et al. | |
| 6,440,924 | B1 | 8/2002 | Jeschke et al. | |
| 6,472,360 | B1 | 10/2002 | Beggs et al. | |
| 6,479,446 | B1 | 11/2002 | Sherry et al. | |
| 6,489,286 | B1 * | 12/2002 | Lukenbach et al. | 510/475 |
| 6,521,584 | B1 | 2/2003 | Soldanski et al. | |
| 6,569,344 | B1 | 5/2003 | Hubesch et al. | |
| 6,593,285 | B1 | 7/2003 | Scheibel et al. | |
| 6,689,223 | B1 | 2/2004 | Meine et al. | |
| 6,767,882 | B1 | 7/2004 | Jagannath et al. | |
| 6,808,557 | B2 | 10/2004 | Holbrey et al. | |
| 6,824,599 | B2 | 11/2004 | Swatloski | |
| 6,900,313 | B2 | 5/2005 | Wasserscheid et al. | |
| 2001/0014654 | A1 | 8/2001 | Davister et al. | |
| 2002/0016269 | A1 | 2/2002 | Noda et al. | |
| 2002/0133886 | A1 | 9/2002 | Severns et al. | |
| 2002/0137657 | A1 | 9/2002 | Lant et al. | |
| 2003/0027473 | A1 | 2/2003 | Kakiuchi et al. | |
| 2003/0045440 | A1 * | 3/2003 | Van der Hoeven et al. | 510/267 |

(Continued)

FOREIGN PATENT DOCUMENTS

CN 1081629 1/2000

(Continued)

OTHER PUBLICATIONS

U.S. Appl. No. 11/263,391, filed Oct. 31, 2005, Price.
U.S. Appl. No. 11/345,569, field Feb. 1, 2006, Hecht.
XP 002375958, Anufrieva, V, Chem. Abstract.
XP 002375959, Beilstein Institut zur Forderung, Chem. Abstract.
XP 002375960, J. Amer. Chem, Chem. Abstract.
XP 002375961, Beilstein Institut zur Forderung, Chem. Abstract.
XP 002375962, Beilstein Institut zur Forderung, Chem. Abstract.
XP 002375963, Beilstein Institut zur Forderung, Chem. Abstract.
John S Wilks, Air and Water Stable 1-Ethyl-3-methylimidazolium Based Ionic Liquids, The rank J. Seller Research Laboratory, United States Air Force Academy, Colorado, US, 1992, pp. 965-967.

(Continued)

*Primary Examiner* — Milton I Cano
*Assistant Examiner* — Thuy-Ai N Nguyen
(74) *Attorney, Agent, or Firm* — Andrew J. Mueller; Leonard W. Lewis

(57) ABSTRACT

A benefit agent delivery system comprises a benefit agent, wherein the benefit agent is protected or stabilized by an ionic liquid and wherein the benefit agent is releasable from the system to provide the benefit. For example, the ionic liquid may be physically associated with the benefit agent, such as by coating, encapsulation, or co-crystallization, or may be chemically associated with the benefit agent, such as by chemical reaction. The benefit agent delivery system may be in the form of a concentrate, in a product formulation, or on or associated with a substrate or package. Detergent compositions may include the benefit agent delivery system.

12 Claims, No Drawings

U.S. PATENT DOCUMENTS

| | | | | |
|---|---|---|---|---|
| 2003/0060378 | A1* | 3/2003 | Hsu et al. | 510/130 |
| 2003/0109405 | A1 | 6/2003 | Kellar et al. | |
| 2003/0119709 | A1* | 6/2003 | Scheper | 510/466 |
| 2003/0139312 | A1 | 7/2003 | Caswell et al. | |
| 2004/0005286 | A1 | 1/2004 | Giroud | |
| 2004/0007693 | A1 | 1/2004 | Moulton et al. | |
| 2004/0035293 | A1 | 2/2004 | Davis, Jr. | |
| 2004/0054231 | A1 | 3/2004 | Abbott et al. | |
| 2004/0077519 | A1 | 4/2004 | Price | |
| 2004/0096932 | A1 | 5/2004 | Kragl et al. | |
| 2004/0097755 | A1 | 5/2004 | Abbott et al. | |
| 2004/0133058 | A1 | 7/2004 | Arlt et al. | |
| 2004/0142840 | A1 | 7/2004 | de Buzzaccarini et al. | |
| 2004/0167265 | A1 | 8/2004 | Thompson et al. | |
| 2004/0198629 | A1* | 10/2004 | Raehse et al. | 510/447 |
| 2004/0198902 | A1 | 10/2004 | Yui et al. | |
| 2005/0143269 | A1 | 6/2005 | Wei et al. | |
| 2006/0079418 | A1 | 4/2006 | Wagner et al. | |
| 2006/0079421 | A1 | 4/2006 | Wagner et al. | |
| 2006/0090777 | A1 | 5/2006 | Hecht | |
| 2006/0094615 | A1 | 5/2006 | Hecht | |
| 2006/0094616 | A1 | 5/2006 | Hecht | |
| 2006/0094617 | A1 | 5/2006 | Price et al. | |
| 2006/0094620 | A1 | 5/2006 | Jordan, IV | |
| 2006/0094621 | A1 | 5/2006 | Jordan, IV | |
| 2006/0166856 | A1 | 7/2006 | Petrat et al. | |
| 2006/0240727 | A1 | 10/2006 | Price et al. | |
| 2006/0240728 | A1 | 10/2006 | Price et al. | |

FOREIGN PATENT DOCUMENTS

| | | | |
|---|---|---|---|
| DE | 3 740 899 | | 6/1989 |
| DE | 101 37 047 | A1 | 2/2003 |
| EP | 0 267 175 | | 5/1988 |
| EP | 0 334 427 | | 9/1989 |
| EP | 0 723 006 | A | 7/1996 |
| EP | 0 895 777 | | 2/1999 |
| EP | 1 222 865 | | 7/2002 |
| EP | 1 454 978 | A | 9/2004 |
| FR | 1296756 | | 5/1962 |
| FR | 2 101 710 | A | 3/1972 |
| GB | 1 014 539 | A | 12/1965 |
| GB | 1 269 677 | | 4/1972 |
| JP | 3064368 | | 3/1991 |
| JP | 5178798 | | 7/1993 |
| JP | 2915208 | B2 | 1/1994 |
| JP | 06009767 | A2 | 1/1994 |
| JP | 10265674 | | 6/1998 |
| JP | 11084603 | A2 | 3/1999 |
| WO | WO 96/05802 | | 2/1996 |
| WO | WO 98/32822 | | 7/1998 |
| WO | WO 98/55581 | A | 12/1998 |
| WO | WO 00/01793 | A | 1/2000 |
| WO | WO 01/19200 | A1 | 3/2001 |
| WO | WO 01/77486 | A1 | 10/2001 |
| WO | WO 02/26701 | A2 | 4/2002 |
| WO | WO 02/34722 | A1 | 5/2002 |
| WO | WO 02/38784 | | 5/2002 |
| WO | WO 02/50366 | A1 | 6/2002 |
| WO | WO 03/002702 | | 1/2003 |
| WO | WO 03/057871 | A1 | 7/2003 |
| WO | WO 03/074494 | A1 | 9/2003 |
| WO | WO 2004/022670 | A1 | 3/2004 |
| WO | WO 2004/035018 | A2 | 4/2004 |
| WO | WO 2004/067739 | A2 | 8/2004 |

OTHER PUBLICATIONS

J D Holbrey, Clean Products and Processes (1999) pp. 223, 236.

Richard Swatloski, Dissolution of Cellose with Ionic Liquids, Center for Green Manufacturing and Department of Chemistry, the University of Alabama, (2002) pp. 4974-4975.

David Bradley, Super Solvents, Technology Ireland, Sep. 1999, pp. 47 & 48.

Brycki, Szafran, Formation of the Homoconjugated Cation (N-0 H O-N)+ of *N*-Dodecyl-*N, N*-Dimethylamine Oxide in Carbon Tetrachloride, Journal of Molecular Structure, 239 (1190) pp. 1-11.

Golding, J, Methanesulfonate and *p*-toluenesulfonate salts of the *N*-methyl-*N*-alkylpyrrolidinium and quaternary ammonium cations: novel low cost ionic liquids, Centre for Green Chemistry, School of Chemistry, Monash University, pp. 223-229.

International Search Report.

Office Action for U.S. Appl. No. 10/465,151 mailed Jan. 22, 2007, Filing Date Jun. 19, 2003, Confirmation No. 3213.

Office Action for U.S. Appl. No. 11/472,724 mailed Jun. 22, 2007, Filing Date Jun. 22, 2006, Confirmation No. 5326.

Office Action for U.S. Appl. No. 11/472,724 mailed Jan. 25, 2008, Filing Date Jun. 22, 2006, Confirmation No. 5326.

Office Action for U.S. Appl. No. 11/891,952 mailed Apr. 7, 2008, Filing Date Aug. 14, 2007, Confirmation No. 3367.

* cited by examiner

BENEFIT AGENT DELIVERY SYSTEM COMPRISING IONIC LIQUID

CROSS REFERENCE TO RELATED APPLICATIONS

This application claims priority under 35 U.S.C. §119(e) from Provisional Application Ser. No. 60/624,051, filed on Nov. 1, 2004.

FIELD OF THE INVENTION

The present invention is directed to a benefit agent delivery system wherein the benefit agent is protected or stabilized by an ionic liquid. The benefit agent delivery system may be in the form of a concentrate, included in a product formulation, or on or associated with a substrate or package. The invention is also directed to detergent compositions including the benefit agent delivery system and to methods for cleaning a soiled substrate.

BACKGROUND OF THE INVENTION

In recent years, ionic liquids have been extensively evaluated as environmental-friendly or "green" alternatives to conventional organic solvents for a broad range of organic synthetic applications. Ionic liquids offer some unique characteristics that distinguish them from conventional organic solvents, such as no effective vapor pressure, a broad liquid range, high polarity and charge density, can be either hydrophobic or hydrophilic, and unique solvating properties.

One widely studied class of ionic liquids includes imidazolinium salts, such as butylmethylimidazolinium hexafluorophosphate, also known as BMIM/$PF_6$. Other well known ionic liquids include N-1-ethyl 3-methylimidazolinum chloride aluminum (III) chloride, which is usually referred to as [emim]Cl—$AlCl_3$; and N-butyl pyridinium chloride aluminum (III) chloride, which is usually referred to as [Nbupy] Cl—$AlCl_3$. A broad range of ionic liquids have also been investigated in the following references: U.S. Pat. Nos. 6,048, 388; 5,827,602; US 2003/915735A1; US 2004/0007693A1; US 2004/0035293A1; WO 02/26701; WO 03/074494; WO 03/022812; and WO 04/016570.

Published PCT Application WO 2004/003120 discloses ionic liquid based products suitable for use in surface or air treating compositions, and ionic liquid cocktails containing three or more different and charged ionic liquid components. The products are particularly useful in various consumer product applications, such as home care, air care, surface cleaning, laundry and fabric care applications.

It is desirable to make advantageous uses of the various unique characteristics of the ionic liquid in additional applications.

SUMMARY OF THE INVENTION

Accordingly, the present invention is directed to benefit agent delivery systems which employ ionic liquids to protect or stabilize the benefit agent, wherein the benefit agent is releasable from the system to provide the benefit. In another embodiment, the invention is directed to compositions comprising a detersive component and the benefit agent delivery system. In yet another embodiment, the present invention is directed to a method of treating substrate surfaces with the compositions containing the present delivery system. In a further embodiment, the invention is directed to methods for cleaning a soiled substrate employing the present delivery system.

Additional embodiments of the benefit agent delivery systems, detergent compositions and methods are described in further detail in the following detailed description.

DETAILED DESCRIPTION OF THE INVENTION

The benefit agent delivery system according to the invention comprises a benefit agent releasably associated with an ionic liquid, wherein the benefit agent is protected or stabilized by an ionic liquid and wherein the benefit agent is releasable from the system to provide the benefit. For example, the ionic liquid may be physically associated with the benefit agent, such as by coating, encapsulation, or co-crystallization, or may be chemically associated with the benefit agent, such as by chemical reaction. The benefit agent delivery system may be in the form of a concentrate, in a product formulation, or on or associated with a substrate or package.

The benefit agent may comprise one or more components which are conventionally added to a composition to provide a benefit, for example a surface treating benefit, a cleaning benefit, a scent benefit, an aesthetic benefit, or the like. Such benefit agents are well known in the art for use in detergent compositions and may include, but are not limited to, perfumes, dyes, dye fixative agents, sizings, skin conditioning actives, vitamins, enzymes, surfactants, antimicrobial agents, particulate builders (e.g., silica, zeolites, phosphates) polymeric builders (e.g., polyacrylates, poly(acrylic-maeic) copolymers), chelants, bleaches, bleach catalysts, bleach boosters, bleach activators, softeners, suds suppressants, radical initiators, ultraviolet protection agents, brighteners, and mixtures thereof. Additional examples of suitable benefit agents are disclosed in U.S. Pat. No. 6,488,943, Beerse et al.; U.S. Pat. No. 6,514,932, Hubesch et al; U.S. Pat. No. 6,548, 470, Buzzaccarini et al.; U.S. Pat. No. 6,482,793, Gordon et al.; U.S. Pat. No. 5,545,350, Baker et al; U.S. Pat. No. 6,083, 899, Baker et al; U.S. Pat. No. 6,156,722, Panandiker et al; U.S. Pat. No. 6,573,234, Sivik et al.; U.S. Pat. No. 6,525,012, Price et al.; U.S. Pat. No. 6,551,986, Littig et al; U.S. Pat. No. 6,566,323, Littig et al.; U.S. Pat. No. 6,090,767, Jackson et al.; and/or U.S. Pat. No. 6,420,326, Maile et al.

Ionic liquid as used herein refers to a salt that has a melting temperature of about 100° C. or less, or, in an alternative embodiment, has a melting temperature of about 60° C. or less, or, in yet another alternative embodiment, has a melting temperature of about 40° C. or less. In other embodiments, the ionic liquids exhibit no discernible melting point (based on DSC analysis) but are "flowable" at a temperature of about 100° C. or below, or, in another embodiment, are "flowable" at a temperature of from about 20 to about 80° C., i.e., the typical fabric or dish washing temperatures. As used herein, the term "flowable" means that the ionic liquid exhibits a viscosity of less than about 10,000 mPa·s at the temperatures as specified above. The viscosities of the ionic fluids can be measured on a Brookfield viscometer model number LVD-VII+ at 20° C., with spindle no. S31 at the appropriate speed to measure materials of different viscosities. The sample is pre-conditioned by storing the ionic liquids or cocktails in a desiccator containing a desiccant (e.g. calcium chloride) at room temperature for at least about 48 hours prior to the viscosity measurement. This equilibration period unifies the amount of innate water in the ionic liquid samples.

It should be understood that the terms "ionic liquid", "ionic compound", and "IL" encompass ionic liquids, ionic liquid composites, and mixtures (or cocktails) of ionic liquids. The ionic liquid can comprise an anionic IL component and a cationic IL component. When the ionic liquid is in its liquid form, these components may freely associate with one another (i.e., in a scramble). As used herein, the term "cocktail of ionic liquids" refers to a mixture of two or more, preferably at least three, different and charged IL components, wherein at least one IL component is cationic and at least one IL component is anionic. Thus, the pairing of three cationic and anionic IL components in a cocktail would result in at least two different ionic liquids. The cocktails of ionic liquids may be prepared either by mixing individual ionic liquids having different IL components, or by preparing them via combinatorial chemistry. Such combinations and their preparation are discussed in further detail in US 2004/0077519A1 and US 2004/0097755A1. As used herein, the term "ionic liquid composite" refers to a mixture of a salt (which can be solid at room temperature) with a proton donor Z (which can be a liquid or a solid) as described in the references immediately above. Upon mixing, these components turn into a liquid at about 100° C. or less, and the mixture behaves like an ionic liquid.

Thus, the ionic liquids suitable for use herein may have various anionic and cationic combinations. The ionic species can be adjusted and mixed such that properties of the ionic liquids can be customized for specific applications, so as to provide the desired solvating properties, viscosity, melting point, and other properties, as desired. These customized ionic liquids have been referred to as "designer solvents". Examples of ionic liquids that are useful in the present invention are described in U.S. Pat. Nos. 6,048,388; 5,827,602; US 2003/915735A1; US 2004/0007693A1; US 2004/003120; US 2004/0035293A1; WO 02/26701; WO 03/074494; WO 03/022812; WO 04/016570; and co-filed P&G Case 9817P and 9818P.

Nonlimiting examples of anions and cations suitable for use in the ionic liquids for the present invention are discussed in further detail.

Anions

Anions suitable for use in the ionic liquids of the present invention include, but are not limited to, the following materials:

(1) Alkyl sulfates (AS), alkoxy sulfates and alkyl alkoxy sulfates, wherein the alkyl or alkoxy is linear, branched or mixtures thereof; furthermore, the attachment of the sulfate group to the alkyl chain can be terminal on the alkyl chain (AS), internal on the alkyl chain (SAS) or mixtures thereof: nonlimiting examples include linear $C_{10}$-$C_{20}$ alkyl sulfates having formula:

$$CH_3(CH_2)_{x+y}CH_2OSO_3^-M^+$$

wherein x+y is an integer of at least 8, preferably at least about 10; $M^+$ is a cation selected from the cations of the ionic liquids as described in detail herein; or linear $C_{10}$-$C_{20}$ secondary alkyl sulfates having formula:

$$CH_3(CH_2)_x(CH)(CH_2)_yCH_3 \quad (\text{with } OSO_3^-M^+ \text{ on the CH})$$

wherein x+y is an integer of at least 7, preferably at least about 9; x or y can be 0, $M^+$ is a cation selected from the cations of the ionic liquids as described in detail herein; or $C_{10}$-$C_{20}$ secondary alkyl ethoxy sulfates having formula:

$$CH_3(CH_2)x(CH)(CH_2)yCH_3 \quad (\text{with } O(CH_2CH_2O)_zSO_3^-M^+ \text{ on the CH})$$

wherein x+y is an integer of at least 7, preferably at least about 9; x or y can be 0, $M^+$ is a cation selected from the cations of the ionic liquids as described in detail herein; nonlimiting examples of alkoxy sulfate include sulfated derivatives of commercially available alkoxy copolymers, such as Pluronics® (from BASF);

(2) Mono- and di-esters of sulfosuccinates: nonlimiting examples include saturated and unsaturated $C_{12-18}$ monoester sulfosuccinates, such as lauryl sulfosuccinate available as Mackanate LO-100® (from The McIntyre Group); saturated and unsaturated $C_6$-$C_{12}$ diester sulfosuccinates, such as dioctyl ester sulfosuccinate available as Aerosol OT® (from Cytec Industries, Inc.);

(3) Methyl ester sulfonates (MES);

(4) Alkyl aryl sulfonates, nonlimiting examples include tosylate, alkyl aryl sulfonates having linear or branched, saturated or unsaturated $C_8$-$C_{14}$ alkyls; alkyl benzene sulfonates (LAS) such as $C_{11}$-$C_{18}$ alkyl benzene sulfonates; sulfonates of benzene, cumene, toluene, xylene, t-butyl benzene, di-isopropyl benzene, or isopropyl benzene; naphthalene sulfonates and $C_{6-14}$ alkyl naphthalene sulfonates, such as Petro® (from Akzo Nobel Surface Chemistry); sulfonates of petroleum, such as Monalube 605® (from Uniqema);

(5) Alkyl glycerol ether sulfonates having 8 to 22 carbon atoms in the alkyl moiety;

(6) Diphenyl ether (bis-phenyl) derivatives: Nonlimiting examples include triclosan (2,4,4'-trichloro-2'-hydroxydiphenyl ether) and diclosan (4,4'-dichloro-2-hydroxydiphenyl ether), both are available as Irgasan® from Ciba Specialty Chemicals;

(7) Linear or cyclic carboxylates: nonlimiting examples include citrate, lactate, tartarate, succinate, alkylene succinate, maleate, gluconate, formate, cinnamate, benzoate, acetate, salicylate, phthalate, aspartate, adipate, acetyl salicylate, 3-methyl salicylate, 4-hydroxy isophthalate, dihydroxyfumarate, 1,2,4-benzene tricarboxylate, pentanoate and mixtures thereof;

(8) Alkyl oxyalkylene carboxylates: nonlimiting examples include $C_{10}$-$C_{18}$ alkyl alkoxy carboxylates preferably comprising 1-5 ethoxy units;

(9) Alkyl diphenyl oxide monosulfonate: nonlimiting examples include alkyl diphenyl oxide monosulfonate of the general formula:

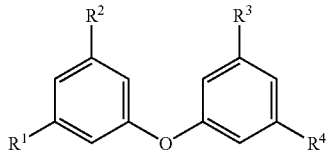

wherein $R^1$ is $C_{10}$-$C_{18}$ linear or branched alkyl; $R^2$ and $R^3$ are independently $SO_3^-$ or H, provided at least one of $R^2$ or $R^3$ is not hydrogen; $R^4$ is $R^1$ or H; suitable alkyl diphenyl oxide monosulfonates are available as DOWFAX® from Dow Chemical and as POLY-TERGENT® from Olin Corp.;

(10) Mid-chain branched alkyl sulfates (HSAS), mid-chain branched alkyl aryl sulfonates (MLAS) and mid-chain branched alkyl polyoxyalkylene sulfates; nonlimiting examples of MLAS are disclosed in U.S. Pat. Nos. 6,596,680; 6,593,285; and 6,202,303;

(11) Alpha olefin sulfonates (AOS) and paraffin sulfonates, nonlimiting examples include $C_{10-22}$ alpha-olefin sulfonates, available as Bio Terge AS-40® from Stepan Company;

(12) Alkyl phosphate esters, nonlimiting examples include $C_{8-22}$ alkyl phosphates, available as Emphos CS® and Emphos TS-230® from Akzo Nobel Surface Chemistry LLC;

(13) Sarcosinates having the general formula $RCON(CH_3)CH_2CO_2^-$, wherein R is an alkyl from about $C_{8-20}$; nonlimiting examples include ammonium lauroyl sarcosinate, available as Hamposyl AL-30® from Dow Chemicals and sodium oleoyl sarcosinate, available as Hamposyl O® from Dow Chemical;

(14) Taurates, such as $C_{8-22}$ alkyl taurates, available as sodium coco methyl tauride or Geropon TC® from Rhodia, Inc.;

(15) Sulfated and sulfonated oils and fatty acids, linear or branched, such as those sulfates or sulfonates derived from potassium coconut oil soap available as Norfox 1101® from Norman, Fox & Co. and Potassium oleate from Chemron Corp.;

(16) Alkyl phenol ethoxy sulfates and sulfonates, such as $C_{8-14}$ alkyl phenol ethoxy sulfates and sulfonates; nonlimiting examples include sulfated nonylphenol ethoxylate available as Triton XN-45S® from Dow Chemical;

(17) Fatty acid ester sulfonates having the formula:

$$R^1—CH(SO_3^-)CO_2R^2$$

wherein $R^1$ is linear or branched $C_8$ to $C_{18}$ alkyl, and $R^2$ is linear or branched $C_1$ to $C_6$ alkyl;

(18) Substituted salicylanilide anions having the formula (I):

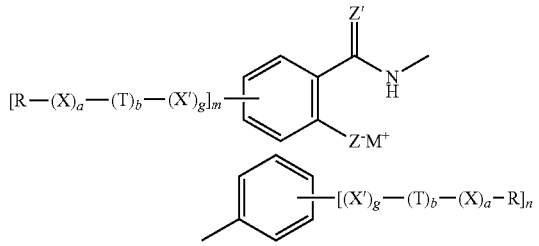

wherein m is an integer from 0 to 4; n is an integer from 0 to 5; the sum of m+n is greater than zero; a is 0 or 1; b is 0 or 1; g is 0 or 1; when b is 0, one of a and g must be 0; Z and Z' are independently selected from O and S; X and X', when present, are selected from O, S, and $NR^1$, where $R^1$ is independently selected from the group consisting of H, $C_1$-$C_{16}$ linear or branched, substituted or unsubstituted alkyl, alkenyl, alkynyl, cycloalkyl, cycloalkenyl, alkaryl, aralkyl, and aryl; T, when present, is selected from C═O, C═S, S═O, and $SO_2$; when T is S═O or $SO_2$, X and X' may not be S; when either a, b or g is 1 for a radical $R—(X)_a—(T)_b—(X')_g—$, R for that radical is independently selected from the group consisting of H, $C_1$-$C_{16}$ linear or branched, substituted or unsubstituted alkyl, alkenyl, alkynyl, cycloalkyl, cycloalkenyl, alkaryl, aralkyl, and aryl; when a, b and g are all 0 for a radical, R for that radical may be further selected from the group consisting of F, Cl, Br, I, CN, $R_2N→O$, $NO_2$; when all a, b and g are 0, at least one R must be non-H; further provided that the total number of halogen atoms in the molecule excluding any present in R does not exceed two; $R^2$ is independently selected from the group consisting of $C_1$-$C_{16}$ linear or branched, substituted or unsubstituted alkyl, alkenyl, alkynyl, cycloalkyl, cycloalkenyl, alkaryl, aralkyl, and aryl, and mixtures thereof; derivatized substituted salicylanilide anions, wherein one or both aromatic rings comprise additional substituents, are also suitable for use herein; substituted salicylanilide and derivatives thereof are disclosed in US 2002/0068014A1 and WO 04/026821; $M^+$ is a cation selected from the cations of the ionic liquids as disclosed herein;

(19) Substituted phenol or thiophenol anions having the formula (II):

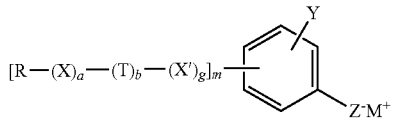

wherein m is an integer from 0 to 4; a is 0 or 1; b is 0 or 1; g is 0 or 1; when b is 0, one of a and g must be 0; Z is selected from O and S; X and X', when present, are selected from O, S, and $NR^1$; when either a, b or g is 1 for a radical $R—(X)_a—(T)_b—(X')_g—$, R for that radical is independently selected from the group consisting of H, $C_1$-$C_{16}$ linear or branched, substituted or unsubstituted alkyl, alkenyl, alkynyl, cycloalkyl, cycloalkenyl, alkaryl, aralkyl, and aryl; when a, b and g are all 0 for a radical, R for that radical may be further selected from the group consisting of F, Cl, Br, I, CN, $R_2N→O$, $NO_2$; T, when present, is selected from C═O, C═S, S═O, and $SO_2$; when T is S═O or $SO_2$, X and X' may not be S; Y is a radical comprising at least 1 but no more than 20 carbon atoms and containing a substituent —X"—H, where X" is selected from O, S, and $N—(T')_{b'}—(X''')_{a'}—R^2$, where a' is 0 or 1, b' is 0 or 1, and X''', when present, is selected from O, S, and $NR^2$; $R^2$ is independently selected from the group consisting of H, $C_1$-$C_{16}$ linear or branched, substituted or unsubstituted alkyl, alkenyl, alkynyl, cycloalkyl, cycloalkenyl, alkaryl, aralkyl, and aryl; T', when present, is selected from C═O, C═S, and $SO_2$; when T' is $SO_2$, X'''may not be S; $R^3$ is independently selected from the group consisting of $C_1$-$C_{16}$ linear or branched, substituted or unsubstituted alkyl, alkenyl, alkynyl, cycloalkyl, cycloalkenyl, alkaryl, aralkyl, and aryl, and mixtures thereof. The substituted phenol or thiophenol anions are disclosed in US 2002/0068014A1 and WO 04/026821; $M^+$ is a cation selected from the cations of the ionic liquids as disclosed herein;

(20) Polyamino polycarboxylates: nonlimiting examples include ethylene ethylenediamine tetraacetate (EDTA), diamine tetracetates, N-hydroxy ethyl ethylene diamine triacetates, nitrilo-tri-acetates, ethylenediamine tetraproprionates, triethylene tetraamine hexacetates, diethylene triamine pentaacetates, and ethanol diglycines;

(21) Aminopolyphosphonates: such as ethylenediamine tetramethylene phosphonate and diethylene triamine pentamethylene-phosphonate;

(22) Sweetener derived anions: saccharinate and acesulfamate;

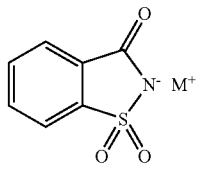

saccharinate

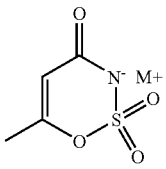

acesulfamate wherein M+ is a cation selected from the cations of the ionic liquids as described herein;

(23) Ethoxylated amide sulfates; sodium tripolyphosphate (STPP); dihydrogen phosphate; fluroalkyl sulfonate; bis-(alkylsulfonyl) amine; bis-(fluoroalkylsulfonyl)amide; (fluroalkylsulfonyl)(fluoroalkylcarbonyl)amide; bis(arylsulfonyl)amide; carbonate; tetrafluorborate ($BF_4^-$); hexaflurophosphate ($PF_6^-$);

(24) Anionic bleach activators having the general formula:

$$R^1—CO—O—C_6H_4—R^2$$

wherein $R^1$ is $C_8$-$C_{18}$ alkyl, $C_8$-$C_{18}$ amino alkyl, or mixtures thereof, and $R^2$ is sulfonate or carbonate; nonlimiting examples such as:

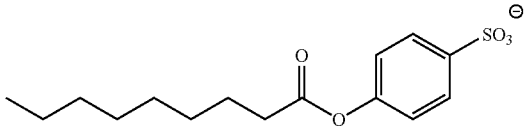

4-nonanoyloxybenzene sulfonate

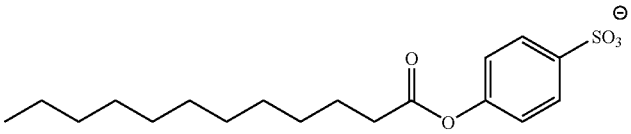

4-dodecanoyloxybenzene sulfonate

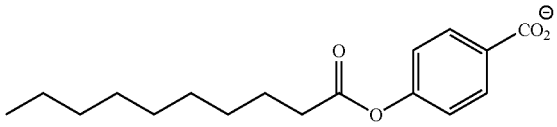

4-decanoyloxybenzoate

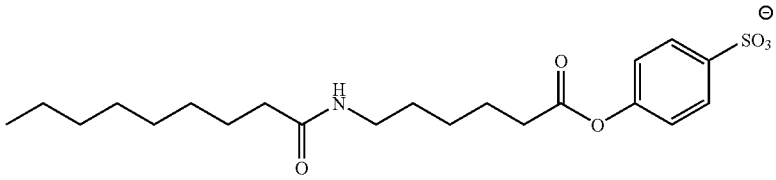

4-[N-(nonanoyl)aminohexanoyloxy]hexanoyloxybenzenesulfonate are disclosed in U.S. Pat. Nos. 5,891,838; 6,448,430; 5,891,838; 6,159,919; 6,448,430; 5,843,879; 6,548,467.

Cations

Cations suitable for use in the ionic liquids of the present invention include, but are not limited to, the following materials:

(a) Cations (i.e., in the protonated, cationic form) of amine oxides, phosphine oxides, or sulfoxides: nonlimiting examples include amine oxide cations containing one $C_{8-18}$ alkyl moiety and 2 moieties selected from the group consisting of $C_{1-3}$ alkyl groups and $C_{1-3}$ hydroxyalkyl groups; phosphine oxide cations containing one $C_{10-18}$ alkyl moiety and 2 moieties selected from the group consisting of $C_{1-3}$ alkyl groups and $C_{1-3}$ hydroxyalkyl groups; and sulfoxide cations containing one $C_{10-18}$ alkyl moiety and a moiety selected from the group consisting of $C_{1-3}$ alkyl and $C_{1-3}$ hydroxyalkyl moieties; in some embodiments, the amine oxide cations have the following formula:

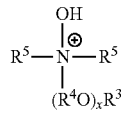

wherein $R^3$ is an $C_{8-22}$ alkyl, $C_{8-22}$ hydroxyalkyl, $C_{8-22}$ alkyl phenyl group, and mixtures thereof; $R^4$ is an $C_{2-3}$ alkylene or $C_{2-3}$ hydroxyalkylene group or mixtures thereof; x is from 0 to about 3; and each $R^5$ is independently an $C_{1-3}$ alkyl or $C_{1-3}$ hydroxyalkyl group or a polyethylene oxide group containing an average of from about 1 to about 3 ethylene oxide groups; the $R^5$ groups may be attached to each other, e.g., through an oxygen or nitrogen atom, to form a ring structure; other exemplary amine oxide cations include $C_{10}$-$C_{18}$, $C_{10}$, $C_{10}$-$C_{12}$, and $C_{12}$-$C_{14}$ alkyl dimethyl amine oxide cations, and $C_8$-$C_{12}$ alkoxy ethyl dihydroxy ethyl amine oxide cations;

(b) Betaines having the general formula:

$$R—N^{(+)}(R^1)_2—R^2COOH$$

wherein R is selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms; nonlimiting examples of betaines include dodecyl dimethyl betaine, acetyl dimethyl betaine, dodecyl amidopropyl dimethyl betaine, tetradecyl dimethyl betaine, tetradecyl amidopropyl dimethyl betaine, dodecyl dimethyl ammonium hexanoate; and amidoalkylbetaines which are disclosed in U.S. Pat. Nos. 3,950,417; 4,137,191; and 4,375,421; and British Patent GB No. 2,103,236; in another embodiment, the cation may be a sulfobetaine, which are disclosed in U.S. Pat. No. 4,687,602;

(c) Diester quaternary ammonium (DEQA) cations of the type:

$$R_{(4-m)}—N^+—[(CH_2)_n—Y—R^1]_m$$

wherein each R substituent is selected from hydrogen; $C_1$-$C_6$ alkyl or hydroxyalkyl, preferably methyl, ethyl, propyl, or hydroxyethyl, and more preferably methyl; poly($C_1$-$C_3$ alkoxy), preferably polyethoxy; benzyl; or a mixture thereof; m is 2 or 3; each n is from 1 to about 4; each Y is —O—(O)C—, —C(O)—O—, —NR—C(O)—, or —C(O)—NR—; with the proviso that when Y is —O—(O)C— or —NR—C(O)—, the sum of carbons in each $R^1$ plus one is $C_{12}$-$C_{22}$, preferably $C_{14}$-$C_{20}$, with each $R^1$ being a hydrocarbyl, or substituted hydrocarbyl group; in one embodiment, the DEQA cation is an alkyl dimethyl hydroxyethyl quaternary ammonium as discussed in U.S. Pat. No. 6,004,922; in another embodiment, the DEQA cation has the general formula:

$$R_3N^+CH_2CH(YR^1)(CH_2YR^1)$$

wherein each Y, R, $R^1$ have the same meanings as before; in yet another embodiment, the DEQA cation is $[CH_3]_3N^{(+)}[CH_2CH(CH_2O(O)CR^1)O(O)CR^1]$ wherein each $R^1$ is in the range of $C_{15}$ to $C_{19}$;

(d) Alkylene quaternary ammonium cations having the formula:

$$R_{(4-m)}—N^+—R^1{}_m$$

wherein each m is 2 or 3; each R is independently an alkyl or hydroxyalkyl $C_1$-$C_6$ moiety, preferably methyl, ethyl, propyl or hydroxyethyl, and more preferably methyl; each $R^1$ is independently a linear or branched, saturated or unsaturated $C_6$-$C_{22}$ alkyl or alkoxy moiety, preferably $C_{14}$-$C_{20}$ moiety, but no more than one $R^1$ being less than about $C_{12}$ and then the other $R^1$ is at least about $C_{16}$; or hydrocarbyl or substituted hydrocarbyl moiety, preferably $C_{10}$-$C_{20}$ alkyl or alkenyl, most preferably $C_{12}$-$C_{18}$ alkyl or alkenyl; in one embodiment, the cation is dialkylenedimethyl ammonium, such as dioleyldimethyl ammonium available from Witco Corporation under the tradename Adogen® 472; in another embodiment, the cation monoalkenyltrimethyl ammonium, such as monooleyltrimethyl ammonium, monocanolatrimethyl ammonium, and soyatrimethyl ammonium;

(e) Difatty amido quaternary ammonium cations such as:

$$[R^1—C(O)—NR—R^2—N(R)_2—R^3—NR—C(O)—R^1]^+$$

wherein R and $R^1$ are as defined in cation (e) above, $R^2$ and $R^3$ are $C_1$-$C_6$ alkylene moieties; for example, difatty amido quats are commercially available from Witco under the Varisoft® tradename;

(f) $C_{8-22}$ quaternary surfactants such as isostearyl ethyl imidonium available in its ethosulfate salt form as Schercoquat IIS® from Scher Chemicals, Inc., quaternium-52 obtainable as Dehyquart SP® from Cognis Corporation, and dicoco dimethyl ammonium available in its chloride salt form as Arquad 2C-75® from Akzo Nobel Surface Chemistry LLC;

(g) Cationic esters such as discussed in U.S. Pat. Nos. 4,228,042, 4,239,660, 4,260,529 and U.S. Pat. No. 6,022,844;

(h) 4,5-dichloro-2-n-octyl-3-isothiazolone, which is obtainable as Kathon® from Rohm and Haas;

(i) Quaternary amino polyoxyalkylene derivatives (choline and choline derivatives);

(j) Alkyl oxyalkylene cations;

(k) Alkoxylate quaternary ammoniums (AQA) as discussed in U.S. Pat. No. 6,136,769;

(l) Substituted and unsubstituted pyrrolidinium, imidazolium, benzimidazolium, pyrazolium, benzpyrazolium, thiazolium, benzthiazolium, oxazolium, benzoxazolium, isoxazolium, isothiazolium, imdazolidenium, Guanidinium, indazolium, quinuclidinium, triazolium, isoquinuclidinium, piperidinium, morpholinium, pyridazinium, pyrazinium, triazinium, azepinium, diazepinium, pyridinium, piperidonium, pyrimidinium, thiophenium; phosphonium; in one embodiment, the cation is an substituted imidazolium cation having the formula:

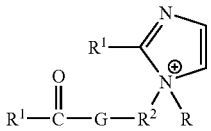

wherein each R and $R^1$ are as defined in cation (e) above; each $R^2$ is a $C_1$-$C_6$ alkylene group, preferably an ethylene group; and G is an oxygen atom or an —NR— group; for example, the cation 1-methyl-1-oleylamidoethyl-2-oleylimidazolinium is available commercially from the Witco Corporation under the trade name Varisoft® 3690; in another embodiment, the cation is alkylpyridinium cation having the formula:

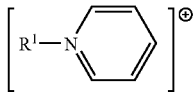

wherein $R^1$ is an acyclic aliphatic $C_8$-$C_{22}$ hydrocarbon group; in another embodiment, the cation is an alkanamide alkylene pyridinium cation having the formula:

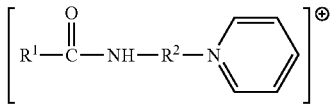

wherein $R^1$ is a linear or branched, saturated or unsaturated $C_6$-$C_{22}$ alkyl or alkoxy moiety, or a hydrocarbyl or substituted hydrocarbyl moiety, and $R^2$ is a $C_1$-$C_6$ alkylene moiety;

(m) Cationic bleach activators having a quaternary ammonium moiety including but not limited to

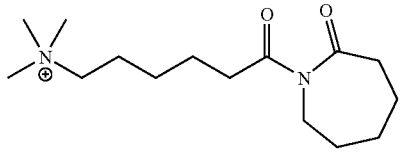

hexahydro-N,N,N-trimethyl-ζ,2-dioxo-1H-azepine-1-hexanaminium

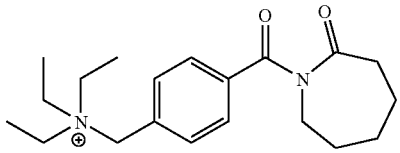

N,N,N-triethyl-4-[(hexahydro-2-oxo-1H-azepin-1-yl) carbonyl]benzenemethanaminium

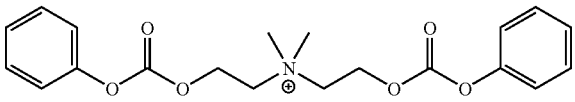

N,N-dimethyl-2-[(phenoxycarbonyl)oxy]-N-[2-[(phenoxycarbonyl)oxy]ethyl]ethanaminium -continued

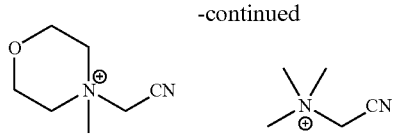

4-(cyanomethyl)-4-methylmorpholinium;
1-cyano-N,N,N-trimethylmethanaminium

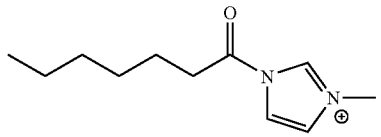

1-methyl-3-(1-oxoheptyl)-1H-Imidazoliumthese and other cationic bleach activators suitable for use herein as cations of the ionic liquids are disclosed in U.S. Pat. Nos. 5,599,781, 5,686,015, 5,686,015, WO 95/29160, U.S. Pat. Nos. 5,599,781, 5,534,179, EP 1 253 190 A1, U.S. Pat. Nos. 6,183,665, 5,106,528, 5,281,361, and Bulletin de la Societe Chimique de France (1973), (3)(Pt. 2), 1021-7;

(n) Cationic anti-microbial agents, such as cetyl pyridinium, chlorohexidine and domiphen;

(o) Alkylated caffeine cations, such as

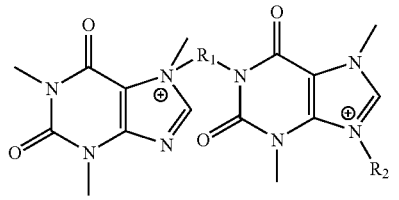

wherein $R_1$ and $R_2$ are C1 to C12 alkyl or alkylene groups.

(p) Alkyl poly amino carboxylates, such as

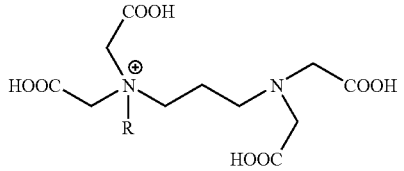

wherein R is $C_8$ to $C_{22}$ alkyl or alkylene groups or is coco, tallow or oleyl; nonlimiting examples include Ampholak® 7CX/C, Ampholak® 7TX/C, and Ampholak® XO7/C from Akzo Nobel.

In some specific embodiments, water immiscible ionic liquid may be employed, for example comprising anion and cation combinations having the formulae:

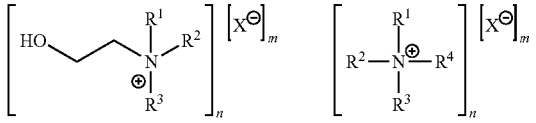

wherein $R^1$-$R^4$ are selected from among the group consisting of linear or branched, substituted or unsubstituted, alkyl, aryl, alkoxyalkyl, alkylenearyl hydroxyalkyl, or haloalkyl; X is an anion such as those described hereinabove; m and n are chosen to provide electronic neutrality; further wherein the ionic liquids are water immiscible when at least one of $R^1$-$R^4$ is C12 or higher; or at least two of $R^1$-$R^4$ are C10 or higher; or at least three of $R^1$-$R^4$ are C6 or higher.

In further embodiments, the water immiscible ionic liquids comprise a cation selected from the group consisting of trimethyloctyl ammonium cation, triisooctylmethyl ammonium cation, tetrahexyl ammonium cation, tetraoctyl ammonium cation, and mixtures thereof, and an anion selected from those described hereinabove.

In yet further embodiments, the water immiscible ionic liquids comprise amine oxide cations and an anion selected from those described hereinabove. In additional embodiments, the water immiscible ionic liquids comprise betaine cations and an anion selected from those described hereinabove.

As discussed herein, in specific embodiments, the ionic liquid may be substantially miscible or immiscible with water, as determined according to the following Ionic Liquid Water Miscibility Test:

A mixture of 0.5 g ionic liquid and 4.5 g de-ionized water are sonicated in a Bransonic Ultrasonic Bath, model no. 1210R-MTH, 50/60 Hz, 117 volts, 1.3 AMPS, according to the manufacturer's specifications for 1.5 hours. Thereafter, if a homogenous transparent system results within 15 minutes of standing without agitation, then the ionic liquid is water miscible. On the other hand, if the resulting mixture appears inhomogeneous, translucent or exhibiting separate phases/layers, the ionic liquid is water immiscible.

In a specific embodiment, the delivery system is substantially free of any water, organic solvents, and dry cleaning solvents (such as silicone solvents, hydrocarbon or halocarbon solvents). As used herein, "substantially free of" indicates that the delivery system contains less than about 10 weight %, more preferably less than about 5 weight %, even more preferably less than about 1 weight %, of the recited component.

The benefit agent is protected or stabilized by the ionic liquid. Within the present disclosure, "protected or stabilized" means that the benefit agent is in a form which maintains its intended activity for later release and use, for example when contacted with a wash system, including aqueous wash systems or dry cleaning systems (employing dry cleaning solvents such as chlorocarbons or silicones). Further, the benefit agent is releasable from the system to provide the benefit, for example when the delivery system is contacted with a wash system. The desired protection or stabilization is provided by associating the ionic liquid and the benefit agent. For example, the ionic liquid may be physically associated with the benefit agent, such as by coating, encapsulation, or co-crystallization, or may be chemically associated with the benefit agent, such as by chemical reaction, to provide such protection or stabilization. If the benefit agent is coated with the ionic liquid, any coating technique known in the art may be employed. Suitable coating methods are disclosed, for example, in WO 03/057871. Such methods comprise melting the ionic liquid suitable for coating the benefit agent at a temperature at or above its melting point, mixing the melted ionic liquid with the benefit agent, for example enzyme powders, and cooling the mixture to solidify the ionic liquid, thereby producing the ionic liquid-coated benefit agent. Finally, the solid product may be subjected to mechanical processing to provide small particles of a desired size. In specific embodiments, the benefit agent may be dissolved or dispersed in the ionic liquid which is in liquid form, whereby melting and/or cooling steps can be avoided. Another method is useful in co-crystallization of the ionic liquid and the benefit agent, wherein the ionic liquid and the benefit agent are dissolved in a common solvent or combination of solvents and, by changing the temperature, pH, ionic strength, and the like, they are precipitated together to produce the co-crystallized delivery system. Further, the ionic liquid and the benefit agent may be selected so as to react with one another without destroying the functionality of the benefit agent while providing an ionic liquid improvement, as discussed herein.

Additionally, any known encapsulation method may be employed to encapsulate the benefit agent, for example perfumes, or combination of benefit agents, within an ionic liquid.

The benefit agents may be included in the delivery system in any amount suitable for achieving the desired association. Typical systems may contain from about 0.0001 to about 40 weight % of the benefit agent(s). In more specific embodiments, such delivery systems may comprise from about 0.001 to about 20 weight %, and more specifically, from about 0.01 to about 10 weight %, of the benefit agent(s). In an alternate embodiment, the delivery system is a concentrate and comprises at least about 50 weight % of the benefit agent. In further embodiments, the delivery system comprises from about 60 to about 95 weight % of the benefit agent, and in further embodiments comprises from about 60 to about 80 weight % of the benefit agent.

In some embodiments, the ionic liquid is provided as a coating or encapsulation on the benefit agent. In a specific embodiment, the ionic liquid is miscible or dissolvable in water, non-aqueous solvents, or dry cleaning solvents, such that the delivery system is capable of releasing the benefit agent when the delivery system is contacted with those liquid media. Such embodiment of the delivery system is particularly suitable for use in granular products; non-aqueous applications, for example, in-home dry cleaning formulations or commercial dry cleaning formulations; and compositions comprising non-aqueous carrier, for example, fabric pre-treating compositions, dish pre-treating compositions, and oven cleaner compositions. In another embodiment, the ionic liquid is water immiscible; it is advantageous for the ionic liquid coating or encapsulation to have a melt temperature at or lower than the intended use temperature, for example, a wash temperature of from about 30° C. to about 80° C. for an automatic dish washer for domestic and commercial or institutional users, or from about 20° C. to about 60° C. for a laundry machine, to obtain release of the benefit agent during use. It is preferable in such embodiments that the ionic liquid exhibits storage stability (including no melting) up to a storage temperature of about 60° C., which is a typical storage temperature a product may experience in warehouse storage or in transit in the summer.

In further embodiments, a sensitive or unstable benefit agent is stabilized by dissolving or dispersing in the ionic liquid, which is in its liquid form and acts as a solvent for the benefit agent. For example, peracid bleach may be stabilized in the ionic liquid and thus will not lose its bleaching activity. Embodiments of the delivery system can be in the form of stabilized concentrates of bleaches that are particularly suitable for use in delivering bleaching benefits in laundry bleach concentrate, laundry or dish pre-treating compositions (typically in non-aqueous solvent carriers), and the like.

The protection or stabilization provided by the ionic liquid provides an improvement to the benefit agent and therefore the compositions and methods employing the delivery system. The improvement may be in the preparation of the benefit agent, in the delivery of the benefit agent, and/or in the performance of the benefit agent in the compositions. For example, the ionic liquid association may provide enhanced selectivity in organic synthesis of the benefit agent, enhanced stability of the benefit agent in the detergent composition carrier, for example in an aqueous or organic solvent, or enhanced stability of the benefit agent over a broad temperature range, or the like. Further, the ionic liquid association may provide enhanced stability and/or activity of the benefit agent in aqueous wash and/or rinse environments, and or in silicone wash systems. Additionally, the ionic liquid association can be selected to facilitate delayed release and/or controlled release of the benefit agent.

In a specific embodiment, the benefit agent comprises an enzyme and the enzyme is coated with or encapsulated by an ionic liquid. In another specific embodiment, the benefit agent comprises a perfume, and the ionic liquid encapsulates or is chemically reacted with the perfume. In a preferred embodiment of such a delivery system, the delivery system is included in a laundry detergent composition and the ionic liquid not only acts as a carrier for the perfume but improves deposition of the perfume on garments washed with the detergent composition. Additionally, the ionic liquid may allow delayed release of the perfume during drying of the garments washed with the detergent.

In a further specific embodiment, the benefit agent comprises a bleach, and the ionic liquid is co-crystallized with the bleach to improve stability of the bleach. In a more specific embodiment, the bleach comprises a preformed peracid, such as phthalimido-peroxy-caproic acid ("PAP"), nononoylamide of either peroxysuccinic acid ("NAPSA") or peroxyadipic acid ("NAPAA"), N,N'-terephthaloyl-di(6-aminoperoxycaproic acid) ("TPCAP"), N-lauroyl-6-aminoperoxycaproic acid ("LAPCA"), N-decanoyl-aminoperoxycaproic acid ("DAPCA"), N-nonanoyl-6-aminoperoxycaproic acid ("NAPCA") and/or 6-decylamino-6-oxoperoxycaproic acid ("DAPAA"). Such preformed peracids are described in more detail in U.S. Pat. Nos. 5,487,818, 5,310,934, 5,246,620, 5,279,757, 5,132,431, 4,634,551 and U.S. Pat. No. 5,770,551. In a more specific embodiment, the benefit agent comprises PAP.

The delivery systems and compositions containing the systems of the present invention may be aqueous or non-aqueous, as desired. Many ionic liquids are hygroscopic, thus, may contain appreciable amounts of water (referred to herein as the "innate" or "bound" water) ranging from about 0.01% to about 50% by weight of the ionic liquid. It should be noted that "free water" or "added water" may be added in making the delivery system and compositions of the present invention. A person of ordinary skill in the art would recognize that once the components (e.g., innate water and free water) are mixed in a composition, the components can no longer be distinguished by their origin and will be reported in totality as percentage of the overall composition. Thus, in one embodiment, the delivery system and/or compositions of the present invention may comprise water, regardless of its origin, ranging from about 0.01% to about 99%, preferably from about 1% to about 75%, more preferably from about 5% to about 50% by weight of the composition. The compositions may optionally include a co-solvent. Typical examples of co-solvents include, but are not limited to, linear or branched $C_1$-$C_{10}$ alcohols, diols, and mixtures thereof. In specific embodiments, co-solvents such as ethanol, isopropanol, propylene glycol are used in some of the compositions of the present invention. In additional specific embodiments, the ionic liquid composition is substantially free of any water and/or organic solvents. These compositions will contain less than about 10 weight percent, more specifically less than about 5 weight percent, even more specifically less than about 1 weight percent, any water and/or organic solvents.

In some embodiments, the delivery systems further comprise a carrier, which is a sheet substrate (for example, woven, nonwoven or knitted webs or foam webs), a granular material (for example, silicas, aluminas, clays) or a liquid carrier (such as water, dry cleaning solvents, co-solvents disclosed above). The delivery systems and/or compositions containing the same may be formulated in the form of liquid, gel, paste, foam, or solid. When the delivery systems or compositions are in the solid form, they can be further processed into granules, powders, tablets, or bars. The composition may also be provided in a unit dose form, which comprises the delivery system of the present invention or a substantially non-aqueous composition comprising the delivery system and a water soluble package comprising a polymeric film that readily dissolves or disperses in use.

The delivery system according to the present invention may be employed in a detergent composition comprising a detersive component. Such compositions may be used for cleaning hard surfaces, for example, including but not limited to, household hard surfaces (such as kitchen surfaces, bathroom surfaces, floors, windows, mirrors and countertops), car hard surfaces (such as automobile interiors, automobile exteriors, metal surfaces and windshields), household articles (such as dishware, cookware, utensils, tableware and glassware), textile surfaces, for example, including, but not limited to, carpets, fabrics (such as woven textiles, nonwoven textiles, knitted textiles and the like, in the form of upholstery, drapes, garments, and/or linens), and/or other soiled surfaces.

Detersive components are known in the art and any detersive component, or combination thereof, as desired may be employed in the compositions of the invention. For example, the detersive component may comprise anionic, nonionic, cationic, zwitterionic and/or amphoteric surfactant. Suitable anionic surfactants include the alkyl benzene sulfonic acids and their salts as well as alkoxylated or non-alkoxylated alkyl sulfate materials; alkyl ether sulfates; and alkyl polyethoxylate sulfates. The linear alkyl benzene sulfonates are known as "LAS" and preferred embodiments contain $C_{11}$-$C_{14}$ alkyls. Suitable nonionic surfactants include amine oxide surfactants and alkoxylated fatty alcohols, preferably have a hydrophilic-lipophilic balance (HLB) which ranges from about 3 to 17, more preferably from about 6 to 15, most preferably from about 8 to 15. In a more specific embodiment, the detergent composition comprises anionic surfactant, nonionic surfactant, or mixtures thereof, with the weight ratio of anionic to nonionic in such mixtures typically ranging from 10:90 to 95:5, more typically from 30:70 to 70:30. Cationic surfactants are well known in the art and nonlimiting examples of these include quaternary ammonium surfactants, which can have up to 26 carbon atoms. Nonlimiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds, betaines, and amine oxides. Nonlimiting examples of ampholytic surfactants include: aliphatic derivatives of secondary or tertiary amines, or aliphatic derivatives of heterocyclic secondary and tertiary amines in which the aliphatic radical can be straight- or branched-chain.

Surfactants or other detersive components will be employed in the detergent composition in an amount sufficient to provide desired cleaning properties. In one embodiment, the composition comprises, by weight, from about 5% to about 90% of the detersive component, and more specifically from about 5% to about 70% of detersive component, and even more specifically from about 5% to about 40% of detersive component.

Alternatively, the detergent composition may comprise carriers such as linear or cyclic silicones, such as decamethylcyclopentasiloxane (D5). Such compositions are particularly suitable for dry-cleaning applications, both in commercial and in-home dry-cleaning methods. Typical compositions for silicone wash system will contain a silicone component in amounts of from about 1 to 99% by weight of the composition, preferably from about 5 to about 95% by weight of the composition, more preferable from about 20 to about 80% by weight of the composition.

The detergent compositions of the present invention can also include any number of additional optional ingredients and/or benefit agents which are not associated with an ionic liquid. These include conventional detergent composition components such as detersive builders, enzymes, enzyme stabilizers (such as propylene glycol, boric acid and/or borax), suds suppressors, soil suspending agents, soil release agents, other fabric care benefit agents, pH adjusting agents, chelating agents, smectite clays, solvents, hydrotropes and phase stabilizers, structuring agents, dye transfer inhibiting agents, optical brighteners, perfumes and coloring agents. The various optional detergent composition ingredients, if present in the compositions herein, should be utilized at concentrations conventionally employed to bring about their desired contribution to the composition or the laundering operation. Frequently, the total amount of such optional detergent composition ingredients can range from about 0.01% to about 50%, more preferably from about 1% to about 30%, by weight of the composition. The benefit agent of the delivery system can range from about 0.0001% to about 40% by weight of the composition.

The compositions of the present invention may be provided in various application forms, including, but not limited to, hand dishwashing detergents, automatic dishwashing detergents, pretreating dish or laundry compositions, hand laundry detergents, automatic laundry detergents, household surface cleaners, car surface cleaners, and the like.

The composition may be employed as a component of another cleaning product, for example by application to an absorbent substrate to provide a wipe for use in various applications. Any suitable absorbent substrate may be employed, including woven or nonwoven fibrous webs and/or foam webs. It is preferred that such an absorbent substrate should have sufficient wet strength to hold an effective amount of the detergent composition according to the present invention to facilitate cleaning.

To facilitate provision of a hand-washing composition, in one embodiment it is preferred that the composition is high-foaming. It should therefore be insured that the second ionic liquid phase does not inhibit foam formation or duration significantly. On the other hand, to facilitate provision of automatic washing detergents in another embodiment, it is preferred that such compositions are low-foaming to avoid foam formation which is typically unmanageable in automatic washing machines. Thus, such compositions may advantageously further include a suds suppressant.

One method of the present invention is directed to cleaning a soiled surface. The method comprises contacting a soiled surface with a composition as described herein, and removing soil from the surface.

Another method of the present invention is directed to treating a substrate surface. The method comprises contacting a substrate surface with a delivery system as described herein or a composition containing the same, and releasing the benefit agent to the substrate surface.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A benefit agent delivery system, comprising a benefit agent releasably associated with an ionic liquid consisting of a) an amine oxide cation having the formula:

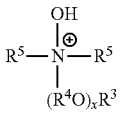

wherein $R^3$ is an $C_{8-22}$ alkyl, $C_{8-22}$ hydroxyalkyl, $C_{8-22}$ alkyl phenyl group, and mixtures thereof; $R^4$ is an $C_{2-3}$ alkylene or $C_{2-3}$ hydroxyalkylene group or mixtures thereof; x is from 0 to about 3; and each $R^5$ is an $C_{1-3}$ alkyl or $C_{1-3}$ hydroxyalkyl group or a polyethylene oxide group containing an average of from about 1 to about 3 ethylene oxide groups; or the $R^5$ groups are attached to each other, through an oxygen or nitrogen atom, to form a ring structure; and b) an anion selected from a group consisting of alkyl aryl sulfonates, mid-chain branched alkyl sulfates, mid-chain branched alkyl aryl sulfonates and mid-chain branched alkyl polyoxyalkyene sulfates;

wherein the benefit agent is coated with or encapsulated by the ionic liquid thereof.

2. The delivery system of claim 1, wherein the ionic liquid is physically or chemically combined with the benefit agent.

3. The delivery system of claim 1, wherein the delivery system further comprising a carrier selected from the group consisting of a sheet substrate, a granular material, or a liquid carrier.

4. The delivery system of claim 1, wherein the ionic liquid is water miscible or water immiscible.

5. The delivery system of claim 1, wherein the benefit agent is selected from the group consisting of perfumes, dyes, dye fixative agents, sizings, skin conditioning actives, vitamins, enzymes, surfactants, antimicrobial agents, builders, chelants, bleaches, bleach catalysts, bleach boosters, bleach activators, softeners, suds suppressants, radical initiators, ultraviolet protection agents, brighteners, and mixtures thereof.

6. The delivery system of claim 1, wherein the benefit agent is an enzyme.

7. The delivery system of claim 1, wherein the benefit agent is a perfume.

8. The delivery system of claim 1, wherein the benefit agent comprises a bleach.

9. A composition comprising a detersive component and the delivery system of claim 1.

10. The composition of claim 9, wherein the composition is a granular detergent or a liquid detergent for treating household hard surfaces, car hard surfaces, household articles, textile or fabric surfaces.

11. The composition of claim 10, wherein the composition is a dish pretreating detergent, a hand washing dish detergent, an automatic dish washing detergent, a fabric pretreating detergent, a laundry detergent, an oven cleaner, a window cleaner, or a household hard surface cleaner.

12. A composition comprising a detersive component and the delivery system of claim 3, wherein the carrier comprises a dry cleaning fluid.

* * * * *

UNITED STATES PATENT AND TRADEMARK OFFICE

CERTIFICATE OF CORRECTION

PATENT NO. : 7,939,485 B2
APPLICATION NO. : 11/263389
DATED : May 10, 2011
INVENTOR(S) : Price et al.

It is certified that error appears in the above-identified patent and that said Letters Patent is hereby corrected as shown below:

Column 17

Line 24, in the bottom line of the formula in Claim 1, delete "$(R^4O)_xR^3$" and insert --$(OR^4)_xR^3$--.

Signed and Sealed this
Twenty-sixth Day of June, 2012

David J. Kappos

David J. Kappos
*Director of the United States Patent and Trademark Office*